US008360280B2

(12) United States Patent
Tournier

(10) Patent No.: US 8,360,280 B2
(45) Date of Patent: Jan. 29, 2013

(54) DIFFUSER DEVICE FOR AN AEROSOL CAN WITH SECURE ACTUATION AND AEROSOL CAN COMPRISING IT

(75) Inventor: Ludovic Tournier, St. Marcellin (FR)

(73) Assignee: I.T.W. Fastex France, St.-Marcellin (FR)

( * ) Notice: Subject to any disclaimer, the term of this patent is extended or adjusted under 35 U.S.C. 154(b) by 812 days.

(21) Appl. No.: 12/373,400

(22) PCT Filed: Jul. 27, 2007

(86) PCT No.: PCT/IB2007/002169

§ 371 (c)(1),
(2), (4) Date: Jan. 12, 2009

(87) PCT Pub. No.: WO2008/032149

PCT Pub. Date: Mar. 20, 2008

(65) Prior Publication Data

US 2009/0256005 A1 Oct. 15, 2009

(30) Foreign Application Priority Data

Sep. 15, 2006 (FR) ..... 06 53776

(51) Int. Cl.
*B65D 83/00* (2006.01)

(52) U.S. Cl. ..... 222/153.11; 222/153.12; 222/402.11; 222/402.13; 239/337

(58) Field of Classification Search ..... 222/402.11, 222/402.13–402.14, 153.04, 153.11–153.12; 239/337–338

See application file for complete search history.

(56) References Cited

U.S. PATENT DOCUMENTS

| | | | | |
|---|---|---|---|---|
| 3,386,631 | A * | 6/1968 | Kotuby | 222/402.11 |
| 3,478,938 | A * | 11/1969 | Krause | 222/402.14 |
| 3,734,353 | A * | 5/1973 | McIlhenny | 222/153.11 |
| 3,894,665 | A * | 7/1975 | Swenson | 222/402.11 |
| 3,918,614 | A * | 11/1975 | Steiman | 222/153.11 |
| 3,967,760 | A * | 7/1976 | Marcon | 222/153.11 |

(Continued)

FOREIGN PATENT DOCUMENTS

| | | |
|---|---|---|
| FR | 2271995 A1 | 12/1975 |
| GB | 2359116 A | 8/2001 |

OTHER PUBLICATIONS

ISR for PCT/IB2007/002169 dated Nov. 12, 2007.
French Search Report for FR 0653776 dated Mar. 26, 2007.

*Primary Examiner* — Kevin P Shaver
*Assistant Examiner* — Andrew P Bainbridge
(74) *Attorney, Agent, or Firm* — Lowe Hauptman Ham & Berner LLP

(57) ABSTRACT

The invention concerns a diffuser device for an aerosol can with secure actuation having a cap, an end piece adapted to be fixed onto a diffusion valve of the aerosol can, the end piece being moveable in a direction of actuation so as to actuate the diffusion valve. An actuator is adapted to cause movement of the end piece in the direction of actuation, the actuator having a second degree of freedom between an initial secure position in which the actuator is blocked with respect to the direction of actuation and at least one unblocked position in which an actuating movement is possible, a cut-out being provided in the cap for the actuator. The actuating has an edge surface which is located, in the initial secure position, facing a rim of the cut-out parallel to the actuating direction, the movement in the second degree of freedom being a movement of pushing-in until the edge surface is clear of the rim.

18 Claims, 3 Drawing Sheets

Figure 1:
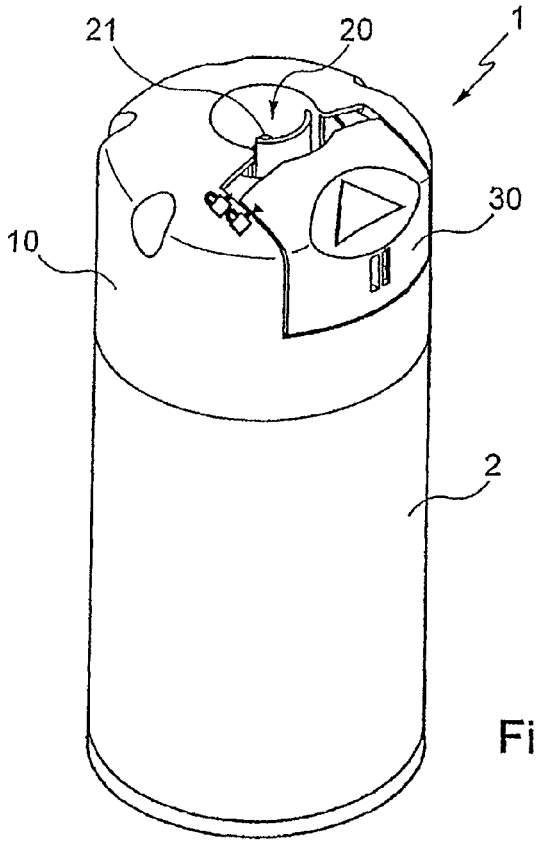

U.S. PATENT DOCUMENTS 4,442,955 A * 4/1984 Bush ..... 222/153.02
4,506,808 A * 3/1985 Goncalves ..... 222/182
6,029,862 A * 2/2000 Jones ..... 222/402.11
6,592,011 B1 * 7/2003 Lammel et al. ..... 222/402.11
6,899,253 B2 * 5/2005 Uemura et al. ..... 222/182
2002/0008119 A1 * 1/2002 Clark et al. ..... 222/153.11

* cited by examiner

DIFFUSER DEVICE FOR AN AEROSOL CAN WITH SECURE ACTUATION AND AEROSOL CAN COMPRISING IT

RELATED APPLICATIONS

The present application is based on International Application Number PCT/IB2007/002169 filed Jul. 27, 2007, and claims priority from, French Application Number 0653776 filed Sep. 15, 2006, the disclosures of which are hereby incorporated by reference herein in their entirety.

The present invention concerns a diffuser device for an aerosol can with secure triggering.

Most aerosol cans are equipped with diffuser devices lacking secure systems capable of preventing the inadvertent diffusion of the products which they contain.

A certain number of solutions to this problem are known from the state of the art: on the one hand there are secure systems to add on to diffuser devices of known type, in particular of push-button type, and on the other hand there are specific diffuser devices with secure triggering.

The diffusers of push-button type are, in general, disposed on the diffusion valve of the aerosol, and are provided with a diffuser orifice for the product contained in the can. These push-buttons have the twin function of actuating the outlet valve of the can and of conducting the product to the outside to diffuse it.

With the diffusers of this type, the most widespread secure system is a protective closure, adapted to be added on to the end of the casing of the can around the diffuser device. This solution proves not to be very practical since it is necessary to use two hands to remove the closure, with the use of a tool to act as a lever sometimes being indispensable.

Another widespread solution, in particular on paint cans, is the use of a removable ring disposed on the crimped collar of the can, under the diffusion push-button so as to prevent its translational movement and the triggering of the diffusion valve. This device is not very convenient since it necessitates the use of both hands to remove the ring. Furthermore, it is generally necessary to use a tool for this and the ring in question is in general a single-use ring, since it is often destroyed on disassembly and hardly repositionable on the collar of the can.

Specific secure diffusers are also known from the state of the art, for example from the documents U.S. Pat. No. 3,963,152 and FR 2 750 960.

A specific diffuser device is also known, with secure actuation, for a deodorant can having a cap adapted to be fixed onto an aerosol can, an end piece adapted to be fixed onto a diffusion valve of the aerosol can, and communicating with an outlet orifice, the end piece being moveable in a direction of actuation so as to actuate the diffusion valve, and an actuator adapted to cause movement of the end piece in the direction of actuation, the actuator being accessible from outside the cap and furthermore having a second degree of freedom between an initial secure position in which the actuator is blocked with respect to the direction of actuation and at least one unblocked position in which an actuating movement is possible, the actuator being positioned in a recess provided for that purpose on the cap, and having a finger cooperating with a rail provided in the recess, the rail being shaped so as to permit a movement in the direction of actuation solely when a movement has been made in the second degree of freedom.

This type of diffuser is difficult to manufacture in that it requires moldings of complex shape, in particular for the rail and the finger, and it proves not to be very effective in practice, since the travel permitted by the finger and the rail in the direction of actuation is small. Furthermore, the kinematics of this device are voluminous, which leaves few possibilities to the designers for arranging the outlet orifice on the cap. Furthermore, this device cannot be used with a spray extension rod.

Other specific diffuser devices with secure triggering are known from the state of the art, for example from the document WO 2005/070813 A1 which describes a diffuser device for an aerosol can with secure actuation comprising a substantially cylindrical cap fixed on the can and open at its end to receive therein an actuator forming an end piece adapted to be fixed on a diffusion valve of the aerosol can, and communicating with an outlet orifice, the actuator being moveable in an actuating direction so as to actuate the diffusion valve, and adapted to cause the movement of the end piece in the actuating direction, the cap having a cam formation cooperating with a portion of the actuator, such that a rotation of the actuator relative to the cap is necessary before reaching a position in which a movement in the direction of actuation becomes possible.

In a variant embodiment, it is necessary to push in a button disposed on the actuator before being able to pivot the actuator about itself to reach the actuation position.

This device is particularly difficult to manipulate in practice, since it necessitates two or three movements before reaching the actuation position, and it is essential for this to use both hands. Furthermore, this device cannot be used with a spray extension rod, and its kinematics complicates the positioning of the outlet orifice.

The present invention aims to mitigate these drawbacks. To that end it provides a diffuser device for an aerosol can with secure actuation comprising:

- a cap adapted to be fixed onto an aerosol can,
- an end piece adapted to be fixed onto a diffusion valve of the aerosol can, and communicating with an outlet orifice, the end piece being moveable in a direction of actuation, so as to actuate the diffusion valve, and
- an actuator adapted to cause movement of the end piece in the direction of actuation, the actuator being accessible from outside the cap, and furthermore having a second degree of freedom between an initial secure position in which the actuator is blocked with respect to the direction of actuation and at least one unblocked position in which an actuating movement is possible, a cut-out being provided in the cap for accessing the actuator and the actuator comprising an edge surface which is located, in the initial secure position, facing a rim of the cut-out parallel to the actuating direction, the movement in the second degree of freedom being a movement of pushing-in until the edge surface is clear of the rim.

Thus, the cut-out formed in the cap is exploited to interfere with the actuator and prevent any inadvertent actuation of the valve in initial secure position.

Thus, the aerosol can may be stored and transported without risk of triggering.

Advantageously, these provisions enable a user to actuate the diffusion from the initial secure position using a single finger.

Furthermore, these provisions result in a space saving, which gives the designer a greater number of possibilities for positioning the outlet orifice.

According to provisions that are preferred, in particular for reasons of convenience, security, performance and ease of manufacture of the diffuser device according to the invention:

- the cap and the end piece are formed in one piece and are connected to each other by a flexible portion permitting relative movement of the end piece with respect to the cap, so as to permit actuation of the diffusion valve;

the flexible portion is elastic, so as to return the end piece to its initial position after an actuation of the diffusion valve;

return means are provided on the end piece or the actuator that are adapted to return the actuator to the initial secure position after an actuation;

the return means are at least one elastic projection projecting from the end piece and of which the free end confronts the actuator;

the end piece comprises hooking means which, in a hooking position, cooperate with complementary means of the actuator adapted to prevent the return of the actuator to the initial position after an actuation;

the hooking means of the end piece are at least one projection extending towards the actuator and provided, at its free end, with a hook-forming triangular shape and adapted to cooperate by latching engagement, respectively, with at least one aperture provided on the actuator facing the triangular shape;

there is at least one intermediate position in which the hooking means do not cooperate with the actuator;

marks are provided on the cap and on the actuator so as to indicate to the user whether the relative position of those two members at a given time is the initial secure position, the hooking position, or an intermediate position;

the hooking means are releasable, so as to permit a return of the actuator to the initial secure position;

in the hooking position, the hooking means are releasable by moving the free end of the at least one projection with respect to the at least one aperture with which the triangular portion cooperates so as to release the hook formed by it from the latching engagement;

the outlet orifice is located substantially on the same axis as the diffusion valve.

It will thus be understood that the user may choose between two modes of actuating the diffusion.

In a first mode, the user presses on the actuator in a radial direction, sufficiently to move the edge surface clear of the rim of the cut-out, and thus be able to diffuse the content of the can. When the user releases the actuator, this returns to its initial secure position by virtue of the return means provided for that purpose.

In the second mode, the user presses on the actuator so as to go beyond the intermediate position and engage the hooking means of the end piece with the complementary means of the actuator, in order to prevent its return to the initial secure position.

In this second mode, the diffusion is continuously permitted, as in a conventional push-button aerosol.

The user will choose this second mode of actuation for example when it is necessary to use a diffusion extension rod or where security is considered not to be useful.

The invention also concerns an aerosol can equipped with a diffusion device as defined above.

According a preferred aspect of the invention, the can contains paint.

Figure 5:
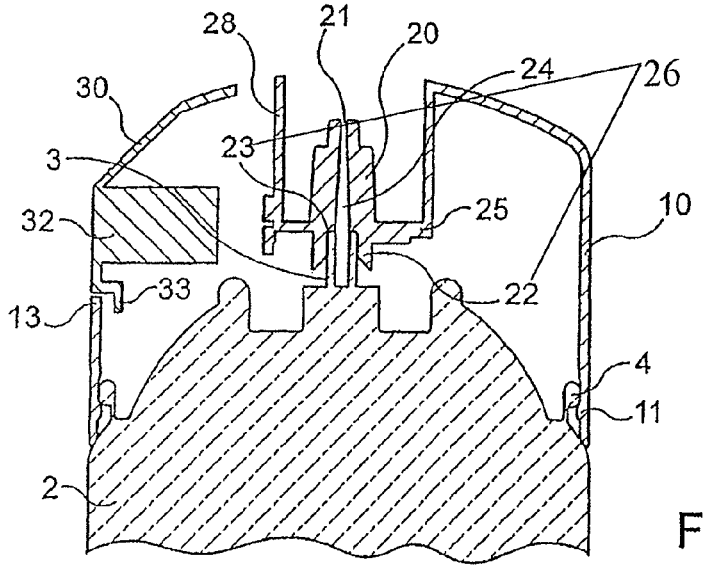
Figure 2:
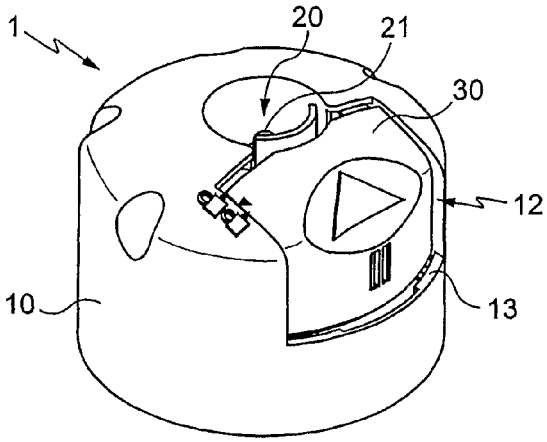
Figure 3:
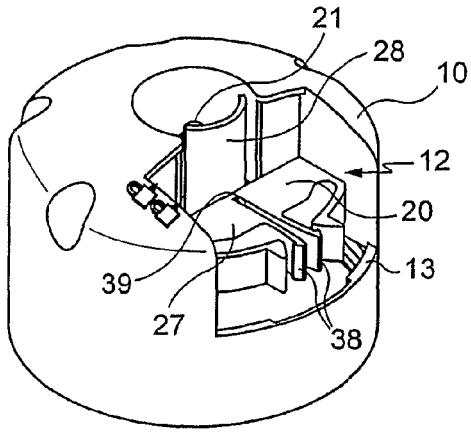
Figure 4:
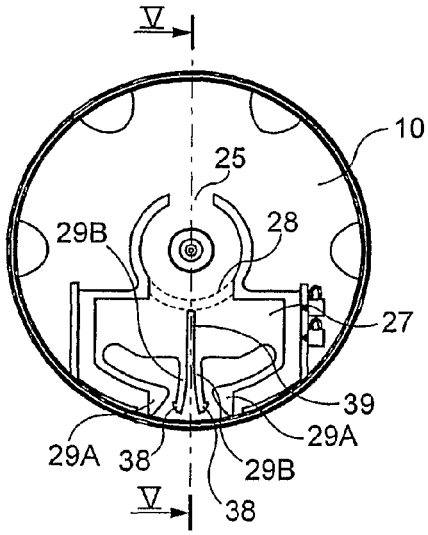
Figure 6:
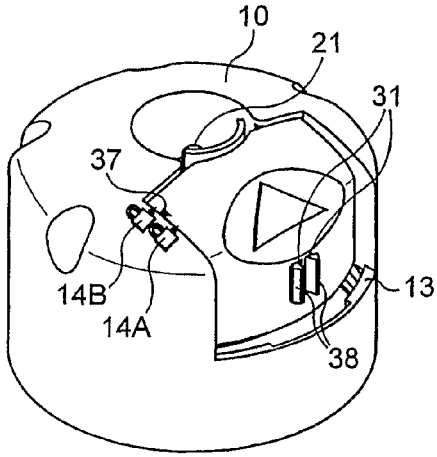
Figure 7:
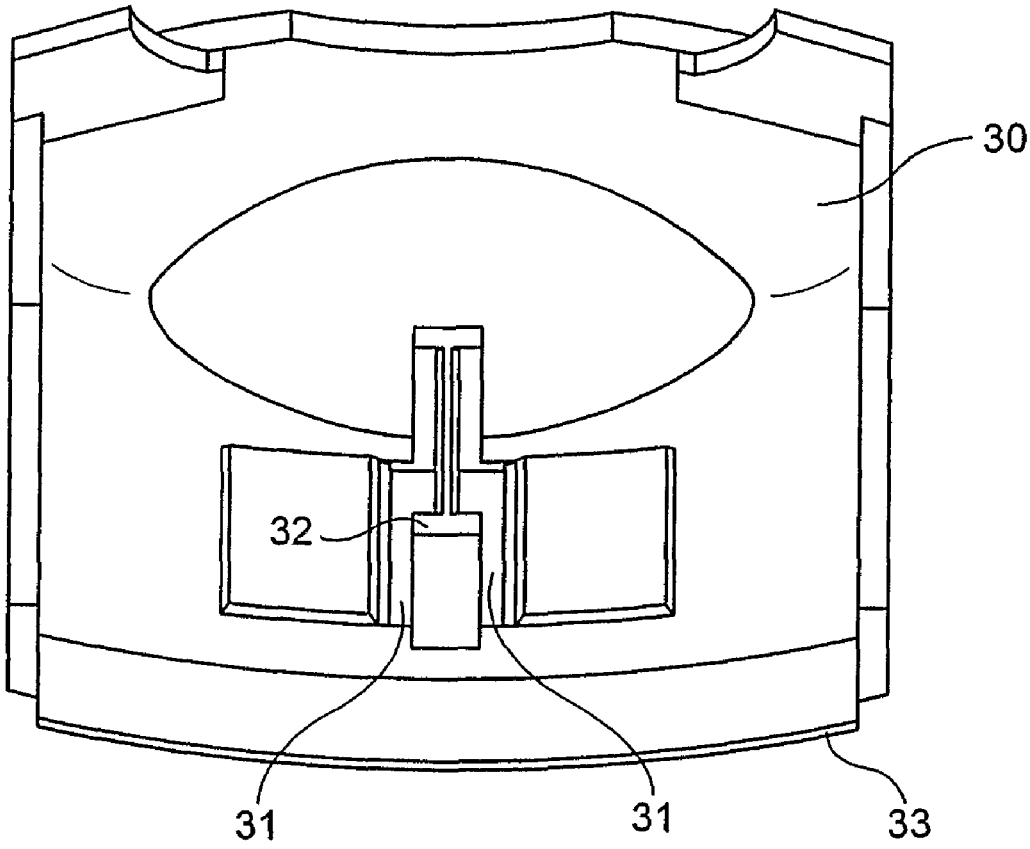

Other features and advantages of the present invention will be better apparent on reading the following description of an embodiment of a diffuser device according to the invention, which is given by way of illustrative example that is no way limiting, and made with reference to the accompanying drawings in which:

FIG. 1 is an overall view of an aerosol can equipped with a diffuser device with secure actuation according to the invention, FIG. 2 is a view of the diffuser device of FIG. 1, the actuator being in intermediate position, FIG. 3 is a view of the same device, the actuator having been removed, FIG. 4 is a view from below of the cap of FIG. 3, FIG. 5 is a diagrammatic view in cross-section of the same device mounted on an aerosol can, on section line V-V of FIG. 4, FIG. 6 is an overall view of the same diffuser device in hooking position, FIG. 7 is a perspective view of the inside surface of the actuator.

The diffuser device 1 with secure triggering according to the invention is adapted to be fixed on an aerosol can 2, as represented in particular in FIG. 1.

The divisor device 1 comprises a cap 10 adapted to be fixed on the aerosol can 2, an end piece 20, adapted to cap a diffusion valve 3 of the can 2 in order to diffuse the content thereof, and an actuator 30, adapted to actuate the diffusion of the content of the can.

As visible especially in FIGS. 3, 4 and 5, the cap 10 adapted to be fixed on the can has substantially the shape of a cylinder, closed at one end by a dome, and of a diameter corresponding to that of the can on which the cap is adapted to be fixed.

At its base, on its inside surface, the cap comprises a bead 11 adapted to be fixed under the crimped collar 4 of the can 2, so as to hold the cap thereon.

The cap further comprises, substantially at its apex, a cut-out 12 provided to receive the actuator 30 and in which an outlet orifice 21 issues to diffuse the content of the can.

The cut-out is formed in the dome and in the cylindrical portion of the cap, so as to have an edge surface 13 that is substantially radial adjacent the cylindrical portion.

Between the cylindrical portion and the dome, the cap has four notches for purely aesthetic reasons.

As can be seen more particularly in FIGS. 3 and 5, in the present embodiment, the end piece 20 is formed in one piece with the cap 10, these two members being connected together by a flexible portion 25.

The end piece 20 and the cap 10 are advantageously formed by the same molding in plastics material.

Going from the flexible portion 25 towards its free radial extremity, the end piece respectively comprises two other portions: a diffusion portion 26 and then a portion 27 for supporting the actuator, delimited by a separating wall 28.

The diffusion portion 26, is adapted for diffusing the content of the can via the outlet orifice 21. To that end, the diffusion portion is provided with a capping member 22 intended for capping the diffusion valve 3, situated on the can 2. Innermost, the capping member 22 has a shoulder 23 permitting a substantially axial force to be exerted on the diffusion valve, in a direction of actuation, so as to open the valve, while allowing the content of the can thus liberated to pass for diffusion in a duct 24, provided in register with the valve 3, to bring the content of the can to the outlet orifice 21.

The support portion 27 is adapted to support the actuator 30 in the cut-out 12, and more particularly to guide its movement therein.

To that end it has a central slot 39 adapted to receive a guide rail 32 of H-shaped cross-section, projecting from the inside surface of the actuator 30, visible more particularly in FIG. 7.

Thus, the actuator 30 is mounted for translational movement relative to the support portion 27. Mounted in this way, the actuator 30 is adapted to move the end piece 20 in the direction of actuation.

In its lower part, the actuator 30 comprises a skirt 33, adapted to form an abutment for translational movement at the edge surface 13 of the cut-out 12, so as to limit the translational movement of the actuator to an initial position designated secure, as can be seen in FIGS. 1 and 5.

The support portion 27 further comprises two C-shaped symmetrical projections forming return springs 29A suitable for biasing the actuator towards the initial secure position. The free ends of the C-shaped projections are disposed so as to confront the inside surface of the actuator 30 when this is mounted on the support portion 27.

The support portion 27 comprises two other symmetrical projections 29B, disposed at its center, between the two springs 29A, and each provided at their free end with a hook-forming triangular shape 38.

The actuator has on respective opposite sides of the rail 32, at its base, two symmetrical apertures 31, provided to be located facing the hooks 38 when the actuator is mounted on the support portion 27.

The hooks 38 are adapted to pass through the apertures 31 so as to retain the actuator 30 in what is designated an actuating position, opposing the return springs 29A. To that end, the projections 29B are slightly curved so as to form springs, and to press each of the hooks 38 on a predetermined edge of the respective aperture 31 (here the two edges furthest from the rail 32). Once in this position, by urging the hooks towards the opposite edge of the each of the apertures 31 it is possible to make the hooks pass through the apertures in the opposite direction, and so free the actuator towards its initial position.

The purpose of the separating wall 28, situated between the diffusion portion 26 and the support portion 27, is in particular to isolate the support section 27 from the outside, in order for example to avoid a foreign body from becoming lodged behind the actuator.

As can be seen more particularly in FIG. 4, the end piece 20, viewed from below, has the same general shape as the cut-out 12, viewed from below. It will also be noted that the support portion 27 is symmetrical in a plane passing through the guide slot 39, which happens to be the cross-sectional plane of FIG. 5.

In the present embodiment, the outlet orifice 21 is advantageously placed in the center of the cap, along the axis of the diffusion valve 3 of the can 2.

In the present embodiment, the actuator is advantageously formed by molding from plastics material.

Markers 14A and 14B are provided on the cap in register with an arrow 37 on the actuator 30 when the latter is placed in the cut-out 12, to enable the user to see the position of the actuator relative to the support portion 27 on actuation.

Thus, the marker 14B indicates to the user that the hooks 38 are engaged in the apertures 31 and that the edge surface 13 has been cleared, and the marker 14A indicates a position in which the edge surface 13 has been cleared, without the hooks 38 being engaged in the apertures 31. This is respectively symbolized by the diagram of a closed and open padlock in the present embodiment.

In operation, the user actuates the actuator in a first phase in a radial direction, so as to move the outer border of the actuator clear of the edge surface 13 of the cut-out. This movement is made in opposition to the action of the springs 29A, of which the free ends are confronted by the inside surface of the actuator 30. Once the actuator 30 has cleared the edge surface 13 (FIG. 2) a movement in the direction of actuation becomes possible. In practice, in the present embodiment, this is possible when the actuator has been displaced by approximately 3 mm in the direction of the outlet orifice 21. This corresponds to the marker 14A provided on the cap.

When the user presses on the actuator in the direction of actuation, the support section 26 fulfills the function of the lever making it possible to actuate the opening of the valve 3 via the shoulder 23, it being possible for the flexible portion 25 to be assimilated to a pivot. Thus, the end piece 20 is moveable relative to the cap 10 in a direction of actuation, so as to actuate the diffusion of the content of the can.

Once the actuation has terminated; the user releases the actuator. The flexible portion 25 is elastic and designed so as to return to its initial position after application of a force directed to actuation of the diffusion valve. The springs 29A then urge the return of the actuator to the initial secure position.

This intermediate actuation mode is used in practice in approximately 90% of the cases of actuation of the diffusion of the content of the can.

At the time of urging the actuator in a radial direction, the user also has the choice of continuing the movement directed to clearing the edge surface 13 in the direction of the outlet orifice until engagement of the hooks 38 in the apertures 31, so as to retain the actuator 30 against the return springs 29A. The actuator is then maintained out of the secure position, even when the user releases the actuator. This corresponds to the marker 14B on the cap, and which, in the present embodiment, correspond to a movement of approximately 5 mm from the initial secure position FIG. 6). The diffuser device can then be assimilated to a conventional device of push-button type. In this configuration, it may easily be implemented with a spray extension rod.

To return to the initial secure position, the user brings the two hooks 38 towards each other, the consequence of which is to move them towards the opposite edge of the respective apertures 31 from that against which each of the hooks is pressed. Thus, the actuator is free to return to its initial secure position under the action of the return springs 29A.

In the present embodiment, the can contains paint and the outlet orifice is adapted to deposit paint so as to mark a surface. Preferably, it is can for marking for applications in industry and the construction sector.

In a variant embodiment not illustrated of a device according to the invention, the outlet orifice is oriented at 900 relative to the axis of the can.

In a variant embodiment not illustrated, the hooking means of the end piece are hidden on the inside of the actuator, without providing apertures therein in order not to spoil its aesthetic appearance.

Lastly, it is to be noted that numerous modifications or variants of the diffuser device described and represented may easily be made by the person skilled in the art without departing from the scope of the invention.

The invention claimed is:

1. A diffuser device for an aerosol can with secure actuation comprising:

a cap configured to be fixed onto the aerosol can, an end piece configured to be fixed onto a diffusion valve of the aerosol can, and communicating with an outlet orifice of the aerosol can, the end piece being moveable in a direction of actuation so as to actuate the diffusion valve, and an actuator configured to cause a movement of the end piece in the direction of actuation, the actuator being accessible from outside the cap and furthermore having an initial secure position in which the actuator is blocked with respect to the direction of actuation, and an intermediate position in which the actuator is moveable inwardly in the direction of actuation from the initial secure position to actuate the diffusion valve and the actuator is returnable from the intermediate position to the initial secure position, and a hooking position to which the actuator is moveable inwardly, in the direction of actuation, from the intermediate position to lock the diffusion valve in the actuated state, wherein the cap has a cut-out for accessing the actuator, and the actuator comprises a surface which abuts, in the initial secure position, a rim of the cut-out, and which is clear of the rim in the intermediate position and in the hooking position.

2. A device according to claim 1, wherein the cap and the end piece are formed in one piece, and are connected to each other by a flexible portion permitting relative movement of the end piece with respect to the cap, so as to permit the actuation of the diffusion valve.

3. A device according to claim 2, wherein the flexible portion is elastic for returning the end piece to an initial position after the actuation of the diffusion valve.

4. A device according to claim 1, further comprising a return element on the end piece or the actuator to return the actuator to the initial secure position after the actuation of the diffusion valve.

5. A device according to claim 4, wherein the return element comprises at least one elastic projection projecting from the end piece, and a free end of the at least one elastic projection faces the actuator.

6. A device according to claim 1, wherein the actuator comprises an aperture, and the end piece comprises a hooking element for, in the hooking position, cooperating with the aperture of the actuator to prevent a return of the actuator to the initial secure position after the actuation of the diffusion valve.

7. A device according to claim 6, wherein the hooking element of the end piece includes at least one projection extending towards the actuator, and a hook-forming triangular portion at a free end of the at least one projection and adapted to pass through said aperture of the actuator to engage with an edge of the actuator by latching engagement.

8. A device according to claim 6, wherein the hooking element, in the intermediate position, is configured not to cooperate with the actuator.

9. A device according to claim 1, further comprising marks on the cap and on the actuator so as to indicate whether a relative position of the cap and the actuator at a given time is the initial secure position, the intermediate position, or the hooking position.

10. A device according to claim 6, wherein the hooking element is releasable, so as to permit a return of the actuator from the hooking position to the initial secure position.

11. A device according to claim 7, wherein, in the hooking position, the hooking element is releasable by a movement of the free end of the at least one projection with respect to the at least one aperture with which the triangular portion cooperates so as to release the hooking element from the latching engagement.

12. A device according to claim 1, wherein the outlet orifice is positionable on the same axis as the diffusion valve.

13. A device according to claim 1, wherein an aerosol can is selectively attached to said diffuser device.

14. A device according to claim 13, wherein the aerosol can contains paint.

15. A device according to claim 6, wherein the actuator further comprises a guide rail on an inside surface of the actuator to guide the actuator to move between the initial secure position and said intermediate position.

16. A device according to claim 15, wherein the end piece further comprises another hooking element for, in the hooking position, cooperating with another aperture of the actuator to prevent a return of the actuator to the initial secure position after the actuation of the diffusion valve, and said hooking element and said another hooking element are spaced away from each other to define a slot for receiving the guide rail of the actuator.

17. A device according to claim 6, wherein the end piece further comprises a return element for returning the actuator to the initial secure position after the actuation of the diffusion valve, and the return element is opposed to the hooking element.

18. A device according to claim 1, wherein the actuator comprises a skirt projecting inwardly from the surface and adapted to abut the rim of the cut-out to retain the actuator in the initial secure position.

* * * * *